United States Patent [19]

North et al.

[11] Patent Number: 4,930,980

[45] Date of Patent: Jun. 5, 1990

[54] COOLED TURBINE VANE

[75] Inventors: William E. North; David T. Entenmann, both of Winter Springs; John P. Donlan, Oviedo, all of Fla.

[73] Assignee: Westinghouse Electric Corp., Pittsburgh, Pa.

[21] Appl. No.: 310,554

[22] Filed: Feb. 15, 1989

[51] Int. Cl.[5] ..... F01D 5/18

[52] U.S. Cl. ..... 415/115; 415/116

[58] Field of Search ..... 415/115, 116; 416/95, 416/96 R, 97 R

[56] References Cited

U.S. PATENT DOCUMENTS

| | | | |
|---|---|---|---|
| 3,369,792 | 2/1968 | Kraimer et al. | 415/115 |
| 3,799,696 | 3/1974 | Redman | 415/115 |
| 3,945,758 | 3/1976 | Lee | 415/144 |
| 4,416,585 | 11/1983 | Abdel-Messeh | 416/97 |
| 4,462,754 | 7/1984 | Schofield | 416/97 |
| 4,666,368 | 5/1987 | Hook, Jr. et al. | 415/115 |
| 4,684,322 | 8/1987 | Clifford et al. | 416/95 |

FOREIGN PATENT DOCUMENTS

| | | | |
|---|---|---|---|
| 938247 | 10/1963 | United Kingdom | 415/115 |

*Primary Examiner*—Robert E. Garrett
*Assistant Examiner*—John T. Kwon

[57] ABSTRACT

A cooled turbine vane in a multistage gas turbine is cooled with a fluid and a major portion of the fluid is dissipated into the gas flow path. A minor portion is supplied to a seal housing and seal for cooling the seal housing and for providing sufficiently cool fluid to the seal. The vane has a hollow airfoil body fixedly attached to the seal housing via an inner shroud and to a blade ring via an outer shroud. An inlet inot the hollow interior of the airfoil body through the outer shroud is in flow communication with a source of coolant fluid. An outlet in the inner shroud is in flow communication with the seal and its housing. Ports in the airfoil body extending from its hollow interior are in flow communication with the gas flow path. In a preferred cooled turbine vane, the coolant fluid in the airfoil body flows through return bends with reduced stagnant zons and flow resistance for increasing the heat transfer across the surfaces of the airfoil body around the bends and for reducing the pressure drop in the bend areas. A bend at the inner shroud is adjacent the outlet and a bend adjacent the outer shroud is adjacent a port for flowing the coolant fluid out of the stagnant zones in the bends.

5 Claims, 2 Drawing Sheets

COOLED TURBINE VANE

FIELD OF THE INVENTION

This invention relates to a fluid cooled turbine vane used in multistage gas turbines.

BACKGROUND OF THE INVENTION

In modern multistage gas turbines, the first several rows of stationary vanes must be cooled with a fluid in order to maintain their structural capability. In these turbines, compressed air is taken from an extraction point on a compressor and supplied to cool the vanes and then is discharged. U.S. Pat. No. 3,945,758, which is assigned to the assignee of the present invention, discloses a turbine having rows of stationary vanes radially extending from seal housings disposed about a rotor adjacent to rows of blades mounted on the rotor structure. Each vane in the later rows has a central elongated airfoil body disposed between an outer shroud attached to a casing and an inner shroud attached to a seal housing. Coolant fluid flows from a source of supply through passages and cavities into inlets in the outer shroud, radially inwardly through parallel channels in the airfoil body and outlets in the inner shroud and then into a chamber generally defined by the inner shroud and the seal housing. The coolant fluid in the chamber cooling the inner shroud and the seal housing then leaks into the hot gases flowing through the turbine around the inner shroud. A portion of the coolant fluid in the chamber leaks through clearance spaces between the seal and the rotor to protect the seal and rotor. U.S. Pat. No. 4,684,322 discloses a different coolant system wherein the coolant fluid is discharged via ports in the airfoil body directly into the hot gases flowing through the turbine. In both of these types of coolant systems, the system is primarily designed to cool the vanes.

It is an object of the present invention to provide a cooled turbine vane having a coolant system for protecting the vane and a second coolant system for protecting the seal and its housing. It is a further object of the present invention to improve the overall efficiency of the turbine by providing the coolant fluid to the vane in smaller quantities and at lower pressures.

SUMMARY OF THE INVENTION

With these objects in view the present invention resides in a cooled turbine vane which is used in the later rows of vanes radially extending from seal housings disposed around a rotor structure adjacent rows of rotatable blades into the path of gases flowing generally axially through the turbine.

The cooled turbine vane has a hollow airfoil body between an inner shroud and an outer shroud. The outer shroud has an inlet in fluid flow communication with a source of coolant fluid for supplying coolant fluid to the hollow interior of the airfoil body. The airfoil body has ports for discharging a portion of the coolant fluid in the hollow interior of the airfoil body into the hot gases flowing through the turbine. The inner shroud has an outlet in fluid flow communication with the seal housing for supplying a portion of the coolant fluid in the hollow interior of the airfoil body to the seal housing and seal. Accordingly the coolant systems may be tailored to meet different coolant requirements at the lowest practical pressure drops for efficiently operating the turbine.

BRIEF DESCRIPTION OF THE DRAWINGS

The invention will become more readily apparent from the following description of preferred embodiments thereof shown, by way of example only, in the accompanying drawings, wherein.

DETAILED DESCRIPTION OF THE DRAWINGS

Figure 1:
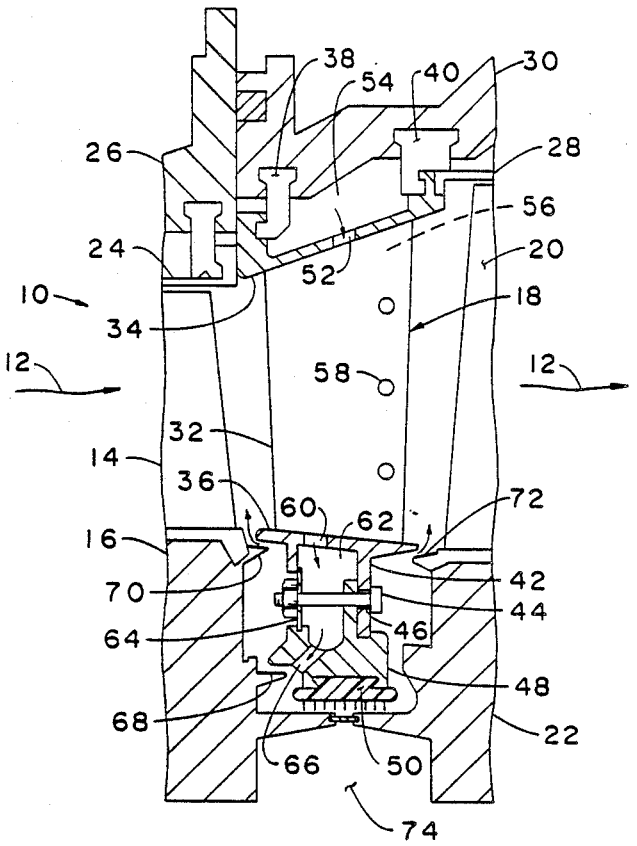
FIG. 1 is a schematic longitudinal section of a portion of an axial flow multistage gas turbine showing an intermediate stage cooled turbine vane employing the present invention.

FIG. 1 generally shows an intermediate stage of a gas turbine 10 such as the turbine of U.S. Pat. No. 3,945,758 which is hereby incorporated by reference for its disclosure of the structure of a turbine employing fluid cooled vanes. High temperature gases flow through the turbine 10 along an axial flow path as designated by arrows 12. The gases flow from an inlet section, through an upstream row of blades including blade 14 rotatably mounted on a turbine disc 16, through a row of stationary vanes including vane 18, through a downstream row of blades including blade 20 rotatably mounted on a turbine disc 22, and to an exhaust section. A ring segment 24 attached to a blade ring 26 disposed around the upstream row of blades and a ring segment 28 attached to a blade ring 30 disposed around the downstream row of blades prevents bypassing of gas around the blades.

The turbine vane 18 has an airfoil body 32 disposed between an outer shroud 34 and an inner shroud 36. The outer shroud 34 is fixedly attached to the blade ring 30 by isolation segments 38, 40. The inner shroud 36 has a root 42 which is fastened by bolt 44 extending through bolt hole 46 to seal housing 48. The seal housing 48 supports a labyrinth seal 50 adjacent to the upstream and downstream turbine discs 16, 22.

The vane 18 absorbs heat from the gases and, therefore, must be cooled with a fluid in order to maintain its structural capability. Thus the outer shroud 34 has an inlet 52 in fluid flow communication with a source of coolant fluid such as an air compressor (not shown) via a cavity 54 defined by the blade ring 30, the outer shroud 34 and the isolation segments 38, 40. The coolant fluid flows into a hollow interior 56 within the airfoil body 32 where it absorbs heat from the vane. As is shown in FIG. 1, the hollow interior 56 may form one channel. The hollow interior 56 may alternatively comprise two or more channels in series for controlling the coolant fluid flow within the hollow interior 56.

A major portion of the coolant fluid in the hollow interior flows through one or more ports 58 in the airfoil body 32 and along its outer surfaces for shielding at least portions of the outer surfaces of the airfoil body 32 from direct contact by high temperature gases flowing along path 12. Thus a portion of the coolant fluid flows through the hollow interior 56 of the airfoil body and along portions of its outer surfaces to protect the vane 18 from the high temperature gases.

A minor portion of the coolant fluid in the hollow interior 56 of the airfoil body 32 flows through an outlet 60 in the inner shroud 36 into a cavity 62 defined by the inner shroud 36, the seal housing 48 and a wall member 64 mounted on the seal housing 48. The coolant fluid in cavity 62 cools the inner shroud 36 and seal housing and then leaks through a passageway 66 in the seal housing into the spaces around the upstream turbine disc 16. A portion of this coolant fluid then leaks through a seal 68 between the upstream disc 16 and seal housing 48, through a seal 70 between the upstream blade 14 and the vane 18 and into the high temperature gas flow path 12. A second portion of this coolant fluid leaks through the clearances between the labyrinth seal 50 and the turbine discs 16, 22 and then past a seal 72 between the vane 18 and the downstream blade 20. The coolant fluid then disperses into the high temperature gas flow path 12. In addition there is a slight leakage of coolant fluid (from another source) from cavity 74 through a seal between the turbine discs 16,22 and into the coolant fluid flowing through the labyrinth seal 50.

Thus only the necessary amount of coolant fluid in the hollow interior 56 of the airfoil body 32 needed to cool the seal housing 48, need be supplied into the cavity 62 around the seal housing 48 and leaked through the seals.

Figure 2:
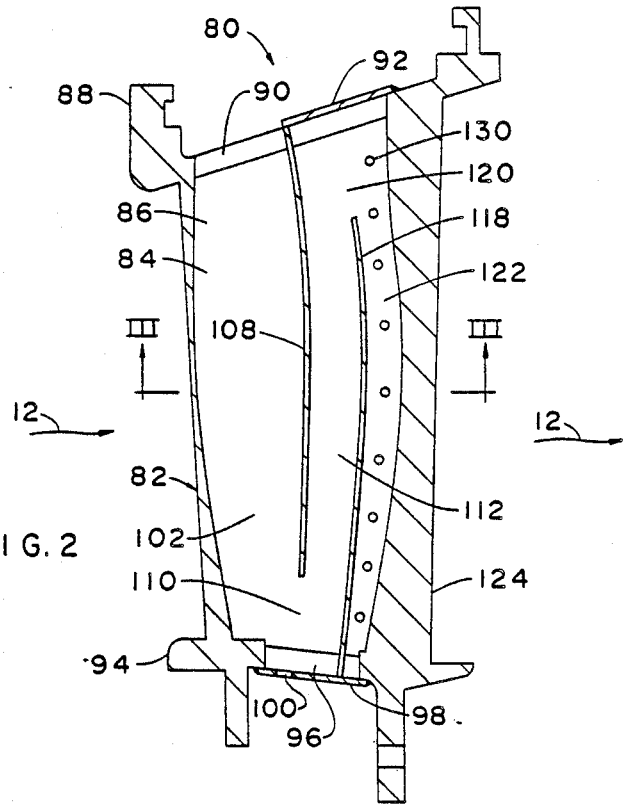
FIG. 2 is a sectional view of a preferred embodiment of the cooled turbine vane generally shown in FIG. 1.
Figure 3:
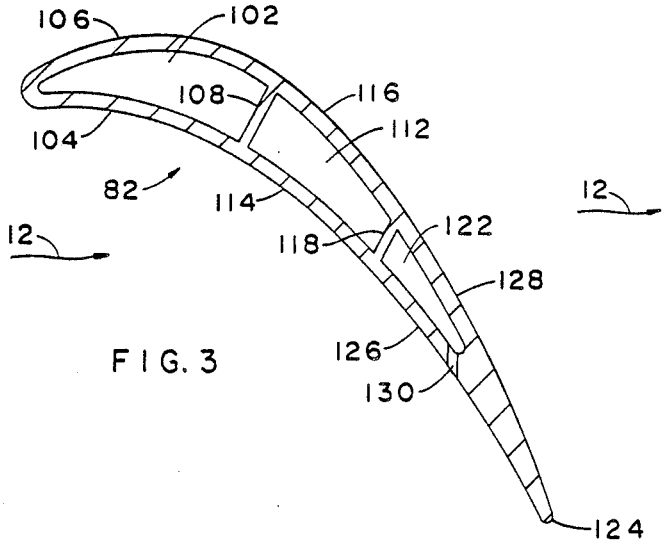
FIG. 3 is a cross-sectional view of the airfoil body shown in FIG. 2 taken along line 3—3.

FIGS. 2 and 3 show a preferred cooled turbine vane 80 generally having an airfoil body 82 with a multipass channel 84 in its hollow interior 86 for maintaining turbulent coolant fluid flow. The channel 84 is designed to obtain the best combination of high heat transfer and low pressure drop so that only minimum amounts of coolant fluid need be supplied at the lowest practical pressures for maximizing overall turbine efficiency.

The vane 80 has an outer shroud 88 with an opening 90 partially covered by a closure plate 92 providing flow communication between the source of coolant fluid and the hollow interior 86 of the airfoil body 82. The vane 80 also has an inner shroud 94 with an opening 96 covered by closure plate 98. The closure plate 98 has one or more holes 100 for providing a portion of the coolant fluid in the hollow interior 86 of the airfoil body 82 to the seal housing 48 shown in FIG. 1. As is most clearly seen in FIG. 3, the multipass channel 84 comprises a first channel 102 spanning the length of the airfoil body 82, which is generally defined by the leading surface 104, 106 of the airfoil body and a first interior wall 108. The first interior wall 108 is integrally cast with the airfoil body 82 and extends from the closure plate 92 toward the inner shroud 94. An inner return bend 110 generally defined by the airfoil body 82 and the inner shroud 94 communicates with the first channel 102 and with an intermediate channel 112 generally defined by the first interior wall 108, the intermediate surfaces 114, 116 of the airfoil body 82 and a second interior wall 118. The second interior wall 118 extends from the inner shroud 94 toward the outer shroud 88 generally parallel to the first interior wall 108. An outer return bend 120 generally defined by the airfoil body 82, the outer shroud 88 and the first interior wall 108 communicates with the intermediate channel 112 and with a third channel 122 adjacent the trailing edge 124 of the airfoil body 82. The third channel 122 is generally defined by the trailing surfaces 126, 128 of the airfoil body 82 and the second interior wall 118. Ports 130 along the trailing edge 124 in the trailing surface 126 of the airfoil body provide flow communication between the third channel 118 and the high temperature gases flowing along path 12. The ports 130 are preferably closely spaced to maintain a film of coolant along the trailing surface.

As shown in FIG. 2, the coolant fluid outlet such as hole 100 in the closure plate 98 is preferably located adjacent the return bend 110 at the end of the first channel 102. Although only a small portion of coolant fluid flows through the hole 100, this flow effectively reduces a zone of stagnant fluid in the boundary of the return bend 110. Thus there is better heat transfer into the coolant fluid in the return bend 110 and there is less pressure drop in the return bend 110. Similarly it is preferable to locate one or more ports 130 adjacent the return bend 120 leading into the subsequent channel 122 so that coolant fluid in the boundary areas of the bend can flow into the gases.

While a presently preferred embodiment of the invention has been shown and described, it is to be distinctly understood that the invention is not limited thereto but may be otherwise variously embodied within the scope of the following claims.

What is claimed is:

1. A cooled turbine vane for use in an multistage gas turbine having rows of fluid cooled vanes radially extending from seal housings into the path of gases flowing generally axially through the turbine, the cooled turbine vane having a hollow airfoil body with ports providing flow communication between its hollow interior and the gas flow path, an outer shroud with a coolant fluid inlet into the hollow interior of the airfoil body providing flow communication with a source of coolant fluid, and an inner shroud with a coolant fluid outlet from the hollow of the airfoil body providing flow communication with a seal housing, said airfoil body having in its hollow interior a multipass coolant fluid channel comprising a first channel extending along the leading surfaces of the airfoil body from the inlet in the outer shroud to a return bend defined by the airfoil body and the inner shroud, and a subsequent channel in fluid flow communication with the first channel extending along the trailing surfaces of the airfoil body in fluid flow communication with the ports, the inlet in the outer shroud and the outlet in the inner shroud being aligned with said first channel, whereby a portion of the coolant fluid flows from the vane through the ports directly into the gas flow path and a portion of the coolant fluid flows through the outlet in the inner shroud.

2. The turbine vane of claim 1 wherein the ports are adjacent the trailing edge of the airfoil body.

3. The turbine vane of claim 1 wherein the outlet in the inner shroud is adjacent the return bend defined by the airfoil body and the inner shroud.

4. The turbine vane of claim 1 wherein the first channel is defined by the airfoil body and an interior wall extending from the outer shroud in spaced relationship with the inner shroud.

5. The turbine vane of claim 4 wherein the airfoil body has two subsequent channels separated by an interior wall extending from the inner shroud in spaced relationship with the outer shroud whereby a return bend communicating the second channel and the third channel is defined by the outer shroud and the airfoil body and wherein at least one port communicating with the gas flow path is disposed adjacent the return bend.

* * * * *